US010094009B2

(12) United States Patent
Fukae et al.

(10) Patent No.: US 10,094,009 B2
(45) Date of Patent: Oct. 9, 2018

(54) SINTERED ALLOY AND PRODUCTION METHOD THEREFOR

(71) Applicant: HITACHI CHEMICAL COMPANY, LTD., Tokyo (JP)

(72) Inventors: Daisuke Fukae, Matsudo (JP); Hideaki Kawata, Matsudo (JP)

(73) Assignee: HITACHI CHEMICAL COMPANY, LTD., Tokyo (JP)

( * ) Notice: Subject to any disclaimer, the term of this patent is extended or adjusted under 35 U.S.C. 154(b) by 319 days.

(21) Appl. No.: 14/954,035

(22) Filed: Nov. 30, 2015

(65) Prior Publication Data

US 2016/0289804 A1 Oct. 6, 2016

(30) Foreign Application Priority Data

Mar. 30, 2015 (JP) ..... 2015-068834

(51) Int. Cl.

| | |
|---|---|
| ***C22C 38/18*** | (2006.01) |
| ***C22C 38/22*** | (2006.01) |
| ***C22C 38/34*** | (2006.01) |
| ***C22C 38/36*** | (2006.01) |
| ***C22C 38/02*** | (2006.01) |
| ***C22C 30/00*** | (2006.01) |
| ***C22C 1/05*** | (2006.01) |
| ***B22F 5/00*** | (2006.01) |
| ***C22C 1/08*** | (2006.01) |
| ***C22C 1/10*** | (2006.01) |
| ***C22C 33/02*** | (2006.01) |

(52) U.S. Cl.

CPC ..... *C22C 38/36* (2013.01); *B22F 5/009* (2013.01); *C22C 1/05* (2013.01); *C22C 1/08* (2013.01); *C22C 1/10* (2013.01); *C22C 30/00* (2013.01); *C22C 33/0207* (2013.01); *C22C 33/0285* (2013.01); *C22C 38/02* (2013.01); *C22C 38/22* (2013.01); *C22C 38/34* (2013.01); *B22F 2998/10* (2013.01)

(58) Field of Classification Search

CPC ..... B22F 1/00; B22F 1/0003; B22F 1/0011; B22F 3/12; B22F 3/16; C22C 33/02; C22C 33/0207; C22C 33/0214; C22C 33/0257; C22C 33/0285; C22C 38/02; C22C 38/12; C22C 38/18; C22C 38/22; C22C 38/24; C22C 38/26; C22C 38/34; C22C 38/36; C22C 38/40; C22C 38/44; C22C 38/46; C22C 38/48; C22C 38/56

See application file for complete search history.

(56) References Cited

U.S. PATENT DOCUMENTS

2002/0139448 A1 10/2002 Hayashi et al.

FOREIGN PATENT DOCUMENTS

JP 3784003 B2 6/2006

*Primary Examiner* — Colleen P Dunn
*Assistant Examiner* — Anthony M Liang
(74) *Attorney, Agent, or Firm* — Oliff PLC

(57) ABSTRACT

A sintered alloy having superior heat resistance and superior wear resistance and also having corrosion resistance against salt damage that may occur in cold-weather regions, and a production method therefor, are provided. The sintered alloy consists of, by mass %, 32.4 to 48.4% of Cr, 2.9 to 10.0% of Mo, 0.9 to 2.9% of Si, 0.3 to 1.8% of P, 0.7 to 3.9% of C, and the balance of Fe and inevitable impurities, and it has a density ratio of not less than 90% and includes carbides that are dispersed in a matrix of a metallic structure thereof.

4 Claims, 1 Drawing Sheet

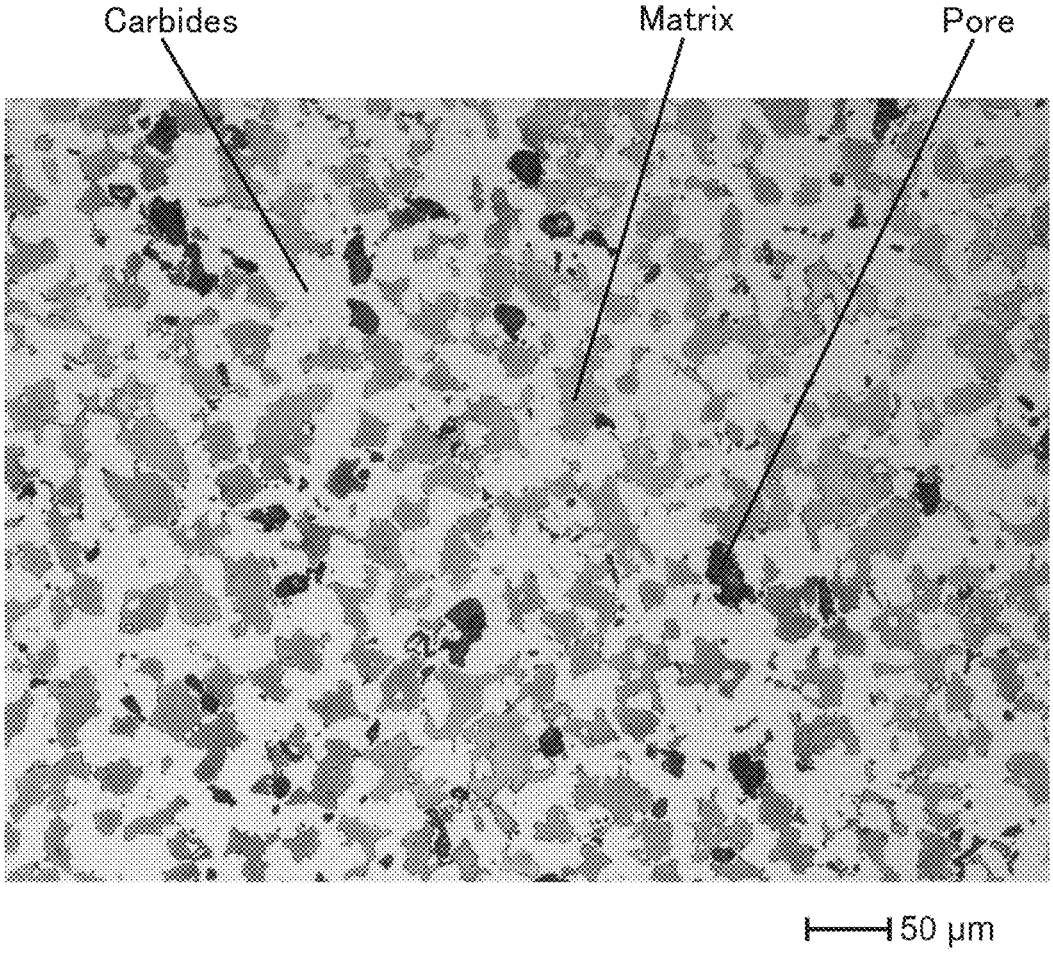
Carbides
Matrix
Pore
50 μm

SINTERED ALLOY AND PRODUCTION METHOD THEREFOR

BACKGROUND OF THE INVENTION

Technical Field

The present invention relates to a sintered alloy and relates to a production method therefor. The sintered alloy may be suitably used for, for example, turbo components of turbochargers, and specifically, heat-resistant bearings that must have heat resistance, corrosion resistance, and wear resistance, and the like.

Background Art

In general, in a turbocharger fixed to an internal combustion engine, a turbine is rotatably supported by a turbine housing that is connected to an exhaust manifold of the internal combustion engine. Exhaust gas flowing in the turbine housing flows from the outer circumference of the turbine into the turbine and is discharged in the axial direction, thereby rotating the turbine. Then, a compressor, which is provided at the same shaft as the shaft of the turbine and is at a side opposite to the turbine, is rotated, whereby air to be supplied to the internal combustion engine is compressed. In such a turbocharger, in order to obtain stable supercharging pressure and to prevent the turbocharger body and the engine from being damaged, when exhaust gas flows from the exhaust manifold into the turbine housing, the amount of the exhaust gas flowing into the turbine is adjusted by separating some of the exhaust gas by switching a nozzle vane or a valve.

A bearing that receives the valve may be exposed to exhaust gas at high temperatures, and therefore, it must be superior in heat resistance and wear resistance. Moreover, since a part of the bearing may be exposed to the outside air together with the turbine housing and thereby be exposed to corrosive conditions due to salt damage or the like, the bearing must have superior corrosion resistance.

On the other hand, since a turbo component of a turbocharger may contact exhaust gas that is corrosive gas at high temperatures, it must have heat resistance in addition to corrosion resistance. Moreover, since the turbo component slidingly contacts the nozzle vane or a valve shaft, it must also have wear resistance. Therefore, for example, high chromium cast steels, wear resistant materials, and the like, are conventionally used. The wear resistant materials may be obtained by performing a chromium surface treatment on SCH22-type materials, as specified by the JIS (Japanese Industrial Standards), in order to improve corrosion resistance. In addition, as a wear resistant component that is superior in heat resistance, corrosion resistance, and wear resistance, and that is low in price, a wear resistant sintered component, which includes carbides that are dispersed in a matrix of a ferrite stainless steel, has been suggested (for example, refer to Japanese Patent No. 3784003).

Meanwhile, since transportation machines such as automobiles, which are equipped with turbochargers, are used under a wide range of conditions from warm-weather regions to cold-weather regions, the turbo component of the turbocharger is also required to be superior in wear resistance and corrosion resistance under a wide range of conditions. For example, in cold-weather regions, a salt such as NaCl (sodium chloride), CaCl (calcium chloride), etc. is sprayed on road surfaces as an antifreeze agent or a snow-melting agent. The salt melts snow and ice, whereby a large amount of water, in which the salt is dissolved at a high concentration, is present on the road surface on which the salt is sprayed. Therefore, when a transport machine travels on such a road surface, the water, in which the salt is dissolved at a high concentration, splashes on the bottom of the transportation machine body. The chloride ions contained in the water in large amounts break a passive film that formed on the surface of stainless steel, causing progressive corrosion. Accordingly, corrosion may occur in a heat resistant bearing for a turbocharger due to salt damage.

The corrosion mechanism of the salt damage is thought to occur as follows. That is, the passive film ($Cr_2O_3$) that is formed on a surface of a stainless steel reacts with Na of NaCl and $H_2O$ and forms water-soluble $Na_2CrO_4$, thereby melting away. Then, as the passive film melts, Cr is correspondingly supplied from an inside of the stainless steel, whereby the amount of Cr in the stainless steel becomes insufficient.

Such corrosion may progress even in a sintered alloy as disclosed in Japanese Patent No. 3784003 under corrosive conditions that may cause salt damage. Accordingly, a new sintered alloy having wear resistance and corrosion resistance is desired as a substitute for the above sintered alloy.

SUMMARY OF THE INVENTION

In view of these circumstances, an object of the present invention is to provide a sintered alloy, which is superior in heat resistance and wear resistance and is also superior in corrosion resistance against salt damage that may occur in cold-weather regions, and to provide a production method therefor.

In order to solve the above problems, the present invention provides a sintered alloy having a feature in the metallic structure, in which a steel including Cr at a relatively high concentration is used as a matrix and carbides are dispersed in the matrix. By forming such a metallic structure, the sintered alloy of the present invention has high wear resistance. The carbides are dispersed in a condition in which they are continuously connected, and they are formed surrounding portions of the matrix. The continuously connected carbides are formed so as to cover a portion called a "chromium-depleted area", and therefore, progression of corrosion is prevented. The chromium-depleted area is formed at a boundary of the matrix and the carbides and includes Cr at a lower concentration, and it can become a starting point of progression of corrosion. Therefore, the sintered alloy of the present invention also exhibits high corrosion resistance. That is, the sintered alloy of the present invention has both high wear resistance and high corrosion resistance, which are improved by forming the above structure.

Specifically, the sintered alloy of the present invention consists of, by mass %, 32.4 to 48.4% of Cr, 2.9 to 10.0% of Mo, 0.9 to 2.9% of Si, 0.3 to 1.8% of P, 0.7 to 3.9% of C, and the balance of Fe and inevitable impurities, and it has a density ratio of not less than 90% and includes carbides dispersed in a matrix of a metallic structure thereof.

It is desirable that the carbides be dispersed in the metallic structure, except for pores, at 30 to 70% by area ratio, in a condition in which they are continuously connected so as to surround portions of the matrix, thereby dividing the matrix into a plurality of the portions. As shown in FIG. 1, in a preferable sintered alloy of the present invention, carbides are continuously connected and surround portions of a matrix. In addition, not all of the carbides are continuously connected, but the carbides are divided at some portions.

The present invention also provides a production method for a sintered alloy, and the method includes preparing an iron alloy powder consisting of, by mass %, 35.0 to 50.0% of Cr, 3.0 to 10.3% of Mo, 1.0 to 3.0% of Si, 0.5 to 2.5% of C, and the balance of Fe and inevitable impurities, an iron-phosphorous alloy powder including P at 10 to 30 mass %, and a graphite powder, mixing 3.0 to 6.0 mass % of the iron-phosphorous alloy powder and 0.2 to 1.5 mass % of the graphite powder with the iron alloy powder so as to obtain a mixed powder, compacting the mixed powder into a green compact, and sintering the green compact.

The sintered alloy of the present invention is suitably used for turbo components of turbochargers. This sintered alloy exhibits a metallic structure, in which metallic carbides are continuously connected and surround portions of a matrix thereof. Therefore, the sintered alloy of the present invention is superior in heat resistance, corrosion resistance, and wear resistance, under high temperatures, and it is not easily corroded by salt damage and exhibits high corrosion resistance even in cold-weather regions.

BRIEF DESCRIPTION OF DRAWING

FIG. 1 is a view showing an example of a photograph of a metallic structure of a sintered alloy of the present invention.

PREFERRED EMBODIMENTS OF THE INVENTION

The size of the carbides greatly affects wear resistance. The wear resistance is improved by forming the carbides as much as possible. In order to obtain high wear resistance, a larger amount of C is required. However, when the amount of C is increased, C combines with Cr in the matrix, whereby the concentration of Cr in the matrix is decreased, and a chromium-depleted area is formed around the carbides, thereby decreasing corrosion resistance.

In the sintered alloy of the present invention, the amounts of Cr and Mo of the alloying components are adjusted so that the area ratio of the carbides is increased and so that portions of the matrix are surrounded by the carbides without increasing the amount of C, whereby both the wear resistance and the corrosion resistance are improved.

The carbides prevent adhesive wear of the base material and also prevent plastic flow. Meanwhile, the metallic carbides including Cr and Mo are difficult to corrode compared to the matrix. Therefore, by surrounding portions of the matrix with the carbides, corrosion at these portions of the matrix is prevented. When the area ratio of the carbides is less than 30%, the amount of carbides is not sufficient to surround plural portions of the matrix, and corrosion may not be prevented. On the other hand, when the area ratio of the carbides is more than 70%, high corrosion resistance is obtained, but the wear characteristics with respect to a mating member is increased. Moreover, when the carbides are formed at more than 70% by area ratio, the sintered alloy is undesirably embrittled. Therefore, the area ratio of the carbides is desirably 30 to 70%.

The area ratio of the carbides may be measured as follows. A cross section of a sintered alloy is mirror polished and is etched by aqua regia (nitric acid:hydrochloric acid=1:3). The metallic structure of the cross section is then observed by microscope at 200-power magnification and is analyzed by using image analyzing software (for example, "WinROOF" produced by Mitani Corporation, etc.).

The sintered alloy of the present invention has an iron alloy matrix which desirably has the composition of a ferrite stainless steel. Ferrite stainless steels are iron alloys, in which Cr is solid solved in Fe, and have high heat resistance and high corrosion resistance, and therefore, they are suitably used as the iron alloy matrix of the present invention. Having the iron alloy matrix with the composition of a ferrite stainless steel, the sintered alloy of the present invention has a thermal expansion coefficient similar to those of ordinary ferrite stainless steels. In order to obtain such an iron alloy matrix, an iron alloy powder, in which Cr and Mo are solid solved in Fe, is used as a main raw powder. These elements are added to iron (or iron alloy) by alloying, whereby they uniformly diffuse in the matrix of the sintered alloy and exhibit corrosion resistance and heat resistance.

The iron alloy matrix of the sintered alloy of the present invention exhibits superior corrosion resistance against oxidizing acids by adding not less than 12 mass % of Cr. In view of this, Cr is added by adjusting its amount included in the iron alloy powder, so that the amount of Cr remaining in the iron alloy matrix of a sintered compact is not less than 12 mass % even when a part of the amount of Cr in the iron alloy powder is precipitated as carbides in sintering. Cr is added in the form of the iron alloy powder so that Cr uniformly affects the entirety of the iron alloy matrix. The amount of Cr added in the form of the iron alloy powder is not less than 35 mass % in the iron alloy powder in consideration of the concentration of Cr in the iron alloy matrix after sintering. On the other hand, when the amount of Cr in the iron alloy matrix of the sintered alloy exceeds 50 mass %, the iron alloy matrix is made of a metallic structure of a single phase of a hard and brittle σ phase, whereby the wear characteristics with respect to a mating member are increased, and the strength of the sintered alloy is decreased. Therefore, the amount of Cr in the iron alloy powder is not more than 50 mass %. Accordingly, in the present invention, the amount of Cr in the iron alloy powder of the main raw powder is set at 35 to 50 mass %.

Mo improves heat resistance and corrosion resistance of the matrix, and it combines with C into carbides, thereby improving wear resistance. As in the case of Cr, Mo is added in the form of the iron alloy powder so that Mo uniformly affects the entirety of the matrix. Moreover, Mo is a carbide-generating element and increases the area ratio of the carbides as the amount of Mo increases, and it thereby helps generation of plural carbides, which are continuously connected, of the present invention. Therefore, when the amount of Mo in the iron alloy power is less than 3.0 mass %, the effect for improving corrosion resistance is not sufficiently obtained. On the other hand, even when the amount of Mo in the iron alloy powder exceeds 10.3 mass %, the effect of the Mo does not further increase. Accordingly, in the present invention, the amount of Mo in the iron alloy powder is set at 3.0 to 10.3 mass %.

Since the iron alloy powder includes a large amount of Cr that is easily oxidized, Si is added as a deoxidizer in a melted metal when the iron alloy powder is produced. In addition, when Si is added and is solid solved in the iron alloy matrix, oxidation resistance and heat resistance of the matrix are improved. When the amount of Si in the iron alloy powder is less than 0.5 mass %, the above effects are not sufficiently obtained. On the other hand, when the amount of Si exceeds 3.0 mass %, the iron alloy powder is excessively hardened, and the compressibility of the mixed powder is greatly degraded. Accordingly, the amount of Si in the iron alloy powder is set at 0.5 to 3.0 mass %, preferably, 1.0 to 3.0 mass %.

When an iron alloy powder includes a large amount of Cr, it may be difficult to sufficiently proceed sintering. Therefore, in the present invention, an iron-phosphorous alloy powder is added to the iron alloy powder so as to generate a liquid phase of a eutectic component of iron-phosphorous-carbon in the sintering, thereby accelerating the sintering. When the amount of P of the iron-phosphorous alloy powder is less than 10 mass %, the liquid phase is not sufficiently generated, and the sintered compact is not sufficiently densified. On the other hand, when the amount of P of the iron-phosphorous alloy powder exceeds 30 mass %, the iron-phosphorous alloy powder is hardened, and the compressibility of the mixed power is greatly degraded. Meanwhile, when the amount of the iron-phosphorous alloy powder is less than 3.0 mass %, the liquid phase is generated in a small amount, whereby the effect for accelerating the sintering is not sufficiently obtained. On the other hand, when the amount of the iron-phosphorous alloy powder exceeds 6.0 mass %, the sintering excessively advances, and the iron-phosphorous alloy powder becomes a liquid phase and easily flows out. As a result, the areas, at which the iron-phosphorous alloy powder particles existed, remain as pores, and a great number of large pores are formed in the iron alloy matrix, whereby corrosion resistance is decreased. Therefore, an iron-phosphorous alloy powder consisting of 10 to 30 mass % of P and the balance of Fe is used at 3.0 to 6.0 mass %.

C is combined with Cr and Mo in the iron alloy matrix and is thereby precipitated and dispersed as composite carbides of iron, chromium, and molybdenum. When the amount of C in the iron alloy is less than 0.7 mass %, the composite carbides are not sufficiently generated, and wear resistance is decreased. On the other hand, when the amount of C exceeds 3.9 mass %, the concentrations of Cr and Mo in the matrix are decreased, whereby corrosion resistance is decreased. Accordingly, the amount of C in the iron alloy is set at 0.7 to 3.9 mass %.

As described above, Cr and Mo are added and are solid solved in the matrix of the iron alloy powder. In such a case, an iron alloy powder including large amounts of alloying compositions tends to be hard and difficult to compact. In view of this, C is solid solved in the iron alloy powder, and parts of the amounts of Cr and Mo, which are to be solid solved in the matrix of the iron alloy powder, are precipitated as the carbides, so that the amounts of Cr and Mo solid solved in the matrix of the iron alloy powder are decreased and so that the hardness of the iron alloy powder is decreased.

C, which is added in the iron alloy powder, diffuses primarily in the form of the carbides in the iron alloy powder, and these carbides in the iron alloy powder become cores for further forming carbides in the sintering and accelerate the formation of the carbides. The carbides are precipitated not only at boundaries among original powder particles in the sintering, but also within the powder particles. Therefore, a part of the amount of C is added in the iron alloy powder, and the rest is added in the form of a graphite powder. C, which is preliminarily added in the iron alloy powder, and C, which is added in the form of the graphite powder, generate a liquid phase of a eutectic component of iron-phosphorous-carbon in conjunction with the iron-phosphorous alloy powder and thereby accelerate the sintering.

When the amount of C in the iron alloy powder is less than 0.5 mass %, the above effects are not sufficiently obtained. On the other hand, when the amount of C in the iron alloy powder exceeds 2.5 mass %, the amount of the carbides in the powder is excessive, whereby the compressibility of the powder is greatly decreased. Therefore, the amount of C in the iron alloy powder is set at 0.5 to 2.5 mass %. On the other hand, the graphite powder is added in order to make up for the amount of C that cannot be preliminarily added to the iron alloy powder, and it reduces oxides on the surfaces of the powder particles in the sintering and accelerates the sintering. When the amount of the graphite powder is less than 0.2 mass %, the above effects are not sufficiently obtained, whereas when the amount of the graphite powder exceeds 1.5 mass %, flowability of the mixed powder is degraded. Accordingly, the amount of the graphite powder is set at 0.2 to 1.5 mass %.

The sintered alloy of the present invention is formed of the mixed powder, in which the iron-phosphorous alloy powder and the graphite powder are added to the iron alloy powder, and consists of, by mass %, 32.4 to 48.4% of Cr, 2.9 to 10.0% of Mo, 0.9 to 2.9% of Si, 0.3 to 1.8% of P, 0.7 to 3.9% of C, and the balance of Fe and inevitable impurities, due to the above described reasons for limiting the kind of the components in each powder and for limiting the amounts of the components.

EXAMPLES

First, iron alloy powders and iron-phosphorous alloy powders having a composition shown in Table 1, and a graphite powder, were prepared, and the iron-phosphorous alloy powder and the graphite powder were added to the iron alloy powder and were mixed at the mixing ratio shown in Table 1, whereby mixed powders were obtained. The mixed powders were compacted into columnar shaped green compacts, which had a compact density of 5.5 $Mg/m^3$ and had an outer diameter of 10 mm and a height of 10 mm, or disk shaped green compacts, which had a compact density of 5.5 $Mg/m^3$ and had an outer diameter of 24 mm and a height of 8 mm. Then, these green compacts were sintered at 1250° C. in a vacuum atmosphere of 100 Pa, whereby sintered alloy samples Nos. 01 to 28 were formed. The overall compositions of these sintered alloy samples are also shown in Table 1.

The columnar shaped sintered alloy samples were used to measure a sintered compact density by the sintered density measuring method specified in Z2505 by JIS.

In the columnar shaped sintered alloy samples, cross sections of the samples were mirror polished and were etched by aqua regia (nitric acid:hydrochloric acid=1:3), and the metallic structures of the cross sections were then observed by microscope at 200-power magnification. Moreover, images of the metallic structures were analyzed by using "WinROOF" that is produced by Mitani Corporation, whereby ratios of carbides in the metallic structures, except for pores, were measured.

Furthermore, the columnar shaped sintered alloy samples were subjected to high temperature corrosion tests using salt water, as follows. That is, these samples were immersed in an aqueous solution of 20% sodium chloride at 25° C. for 20 minutes. Then, the samples were maintained at 500° C. for 2 hours in air in a muffle furnace and were air cooled for 5 minutes, and this cycle was repeated 5 times. Cross sections of the samples after the test were mirror polished and were observed by microscope at 200-power magnification, and the maximum values of the corroded depth from the surface were measured as "corrosion depth".

On the other hand, the disk shaped sintered alloy samples were used as disk members and were subjected to a roll-on-disk frictional wear test as follows. That is, a roll having an outer diameter of 15 mm and a length of 22 mm, which was obtained by performing a chromizing treatment on a material corresponding to SUS316 specified by the JIS (Japanese Industrial Standards), was used as a mating member. The samples were reciprocatingly slid against the mating member at 650° C. for 20 minutes. The wear amounts of the disk members were measured after the test.

These results are shown in Table 2. Regarding evaluation criteria, it should be noted that a sample having a wear amount of not more than 15 μm and a corrosion depth of not more than 15 μm was judged as being acceptable.

TABLE 1

| Sample No. | Mixing ratio mass % Iron alloy powder mass % Fe | Cr | Mo | Si | C | P mass % | Iron-phosphorous alloy powder | Graphite powder | Overall composition mass % Fe | Cr | Mo | Si | P | C | Notes |
|---|---|---|---|---|---|---|---|---|---|---|---|---|---|---|---|
| 01 | Bal. | 25.0 | 5.0 | 2.0 | 1.5 | 20.0 | 4.0 | 1.0 | Bal. | 23.8 | 4.8 | 1.9 | 0.8 | 2.4 | Exceeds lower limit of the amount of Cr |
| 02 | Bal. | 30.0 | 5.0 | 2.0 | 1.5 | 20.0 | 4.0 | 1.0 | Bal. | 28.5 | 4.8 | 1.9 | 0.8 | 2.4 | Exceeds lower limit of the amount of Cr |
| 03 | Bal. | 35.0 | 5.0 | 2.0 | 1.5 | 20.0 | 4.0 | 1.0 | Bal. | 33.3 | 4.8 | 1.9 | 0.8 | 2.4 | |
| 04 | Bal. | 37.0 | 5.0 | 2.0 | 1.5 | 20.0 | 4.0 | 1.0 | Bal. | 35.2 | 4.8 | 1.9 | 0.8 | 2.4 | |
| 05 | Bal. | 40.0 | 5.0 | 2.0 | 1.5 | 20.0 | 4.0 | 1.0 | Bal. | 38.0 | 4.8 | 1.9 | 0.8 | 2.4 | |
| 06 | Bal. | 45.0 | 5.0 | 2.0 | 1.5 | 20.0 | 4.0 | 1.0 | Bal. | 42.8 | 4.8 | 1.9 | 0.8 | 2.4 | |
| 07 | Bal. | 50.0 | 5.0 | 2.0 | 1.5 | 20.0 | 4.0 | 1.0 | Bal. | 47.5 | 4.8 | 1.9 | 0.8 | 2.4 | |
| 08 | Bal. | 55.0 | 5.0 | 2.0 | 1.5 | 20.0 | 4.0 | 1.0 | Bal. | 52.3 | 4.8 | 1.9 | 0.8 | 2.4 | Exceeds upper limit of the amount of Cr |
| 09 | Bal. | 40.0 | 0.0 | 2.0 | 1.5 | 20.0 | 4.0 | 1.0 | Bal. | 38.0 | 0.0 | 1.9 | 0.8 | 2.4 | Exceeds lower limit of the amount of Mo |
| 10 | Bal. | 40.0 | 1.0 | 2.0 | 1.5 | 20.0 | 4.0 | 1.0 | Bal. | 38.0 | 1.0 | 1.9 | 0.8 | 2.4 | Exceeds lower limit of the amount of Mo |
| 11 | Bal. | 40.0 | 2.6 | 2.0 | 1.5 | 20.0 | 4.0 | 1.0 | Bal. | 38.0 | 2.5 | 1.9 | 0.8 | 2.4 | Exceeds lower limit of the amount of Mo |
| 12 | Bal. | 40.0 | 3.0 | 2.0 | 1.5 | 20.0 | 4.0 | 1.0 | Bal. | 38.0 | 2.9 | 1.9 | 0.8 | 2.4 | |
| 05 | Bal. | 40.0 | 5.0 | 2.0 | 1.5 | 20.0 | 4.0 | 1.0 | Bal. | 38.0 | 4.8 | 1.9 | 0.8 | 2.4 | |
| 13 | Bal. | 40.0 | 7.0 | 2.0 | 1.5 | 20.0 | 4.0 | 1.0 | Bal. | 38.0 | 6.7 | 1.9 | 0.8 | 2.4 | |
| 14 | Bal. | 40.0 | 10.3 | 2.0 | 1.5 | 20.0 | 4.0 | 1.0 | Bal. | 38.0 | 9.8 | 1.9 | 0.8 | 2.4 | |
| 15 | Bal. | 40.0 | 12.0 | 2.0 | 1.5 | 20.0 | 4.0 | 1.0 | Bal. | 38.0 | 11.4 | 1.9 | 0.8 | 2.4 | Exceeds upper limit of the amount of Mo |
| 16 | Bal. | 40.0 | 5.0 | 2.0 | 1.5 | 10.0 | 2.0 | 1.0 | Bal. | 38.8 | 4.9 | 1.9 | 0.2 | 2.5 | Exceeds lower limit of the amount of P |
| 17 | Bal. | 40.0 | 5.0 | 2.0 | 1.5 | 10.0 | 3.0 | 1.0 | Bal. | 38.4 | 4.8 | 1.9 | 0.3 | 2.4 | |
| 18 | Bal. | 40.0 | 5.0 | 2.0 | 1.5 | 20.0 | 3.0 | 1.0 | Bal. | 38.4 | 4.8 | 1.9 | 0.6 | 2.4 | |
| 05 | Bal. | 40.0 | 5.0 | 2.0 | 1.5 | 20.0 | 4.0 | 1.0 | Bal. | 38.0 | 4.8 | 1.9 | 0.8 | 2.4 | |
| 19 | Bal. | 40.0 | 5.0 | 2.0 | 1.5 | 20.0 | 6.0 | 1.0 | Bal. | 37.2 | 4.7 | 1.9 | 1.2 | 2.4 | |
| 20 | Bal. | 40.0 | 5.0 | 2.0 | 1.5 | 30.0 | 6.0 | 1.0 | Bal. | 37.2 | 4.7 | 1.9 | 1.8 | 2.4 | |
| 21 | Bal. | 40.0 | 5.0 | 2.0 | 1.5 | 30.0 | 7.0 | 1.0 | Bal. | 36.8 | 4.6 | 1.8 | 2.1 | 2.4 | Exceeds upper limit of the amount of P |
| 22 | Bal. | 40.0 | 5.0 | 2.0 | 0.2 | 20.0 | 4.0 | 0.1 | Bal. | 38.4 | 4.8 | 1.9 | 0.8 | 0.3 | Exceeds lower limit of the amount of C |
| 23 | Bal. | 40.0 | 5.0 | 2.0 | 0.5 | 20.0 | 4.0 | 0.2 | Bal. | 38.3 | 4.8 | 1.9 | 0.8 | 0.7 | |
| 24 | Bal. | 40.0 | 5.0 | 2.0 | 0.8 | 20.0 | 4.0 | 0.5 | Bal. | 38.2 | 4.8 | 1.9 | 0.8 | 1.3 | |
| 25 | Bal. | 40.0 | 5.0 | 2.0 | 1.0 | 20.0 | 4.0 | 0.8 | Bal. | 38.1 | 4.8 | 1.9 | 0.8 | 1.8 | |
| 05 | Bal. | 40.0 | 5.0 | 2.0 | 1.5 | 20.0 | 4.0 | 1.0 | Bal. | 38.0 | 4.8 | 1.9 | 0.8 | 2.4 | |
| 26 | Bal. | 40.0 | 5.0 | 2.0 | 1.8 | 20.0 | 4.0 | 1.3 | Bal. | 37.9 | 4.7 | 1.9 | 0.8 | 3.0 | |
| 27 | Bal. | 40.0 | 5.0 | 2.0 | 2.5 | 20.0 | 4.0 | 1.5 | Bal. | 37.8 | 4.7 | 1.9 | 0.8 | 3.9 | |
| 28 | Bal. | 40.0 | 5.0 | 2.0 | 3.0 | 20.0 | 4.0 | 2.0 | Bal. | 37.6 | 4.7 | 1.9 | 0.8 | 4.8 | Exceeds upper limit of the amount of C |

TABLE 2

| Sample No. | Density ratio % | Area ratio of carbides % | Corrosion depth μm | Wear amount μm | Notes |
|---|---|---|---|---|---|
| 01 | 97 | 24 | 32 | 6 | Exceeds lower limit of the amount of Cr |
| 02 | 96 | 28 | 17 | 6 | Exceeds lower limit of the amount of Cr |
| 03 | 95 | 33 | 10 | 6 | |
| 04 | 94 | 36 | 6 | 6 | |
| 05 | 92 | 48 | 4 | 5 | |
| 06 | 91 | 60 | 3 | 5 | |
| 07 | 90 | 70 | 7 | 5 | |

TABLE 2-continued

| Sample No. | Density ratio % | Area ratio of carbides % | Corrosion depth μm | Wear amount μm | Notes |
|---|---|---|---|---|---|
| 08 | — | — | — | — | Exceeds upper limit of the amount of Cr |
| 09 | 93 | 20 | 36 | 5 | Exceeds lower limit of the amount of Mo |
| 10 | 93 | 25 | 18 | 5 | Exceeds lower limit of the amount of Mo |
| 11 | 92 | 28 | 16 | 5 | Exceeds lower limit of the amount of Mo |
| 12 | 92 | 33 | 8 | 5 | |
| 05 | 92 | 48 | 4 | 5 | |
| 13 | 92 | 58 | 4 | 4 | |

TABLE 2-continued

| Sample No. | Density ratio % | Area ratio of carbides % | Corrosion depth μm | Wear amount μm | Notes |
|---|---|---|---|---|---|
| 14 | 92 | 70 | 3 | 4 | |
| 15 | 92 | 78 | 3 | 4 | Exceeds upper limit of the amount of Mo |
| 16 | 78 | 49 | 60 | 20 | Exceeds lower limit of the amount of P |
| 17 | 90 | 49 | 10 | 10 | |
| 18 | 91 | 48 | 8 | 5 | |
| 05 | 92 | 48 | 4 | 5 | |
| 19 | 91 | 48 | 6 | 5 | |
| 20 | 90 | 48 | 10 | 10 | |
| 21 | 86 | 48 | 50 | 16 | Exceeds upper limit of the amount of P |
| 22 | 86 | 25 | 30 | 18 | Exceeds lower limit of the amount of C |
| 23 | 90 | 30 | 14 | 12 | |
| 24 | 91 | 35 | 6 | 7 | |
| 25 | 91 | 42 | 4 | 6 | |
| 05 | 92 | 48 | 4 | 5 | |
| 26 | 92 | 62 | 6 | 4 | |
| 27 | 92 | 70 | 12 | 4 | |
| 28 | — | — | — | — | Exceeds upper limit of the amount of C |

Effects of Cr

The effects of the amount of Cr on the sintered alloy can be investigated from the results of the sintered alloy samples Nos. 01 to 08 in Table 1.

The sintered compact density ratio was slightly decreased with the increase in the amount of Cr. This is because the amounts of the passive films including chromium on the surfaces of the iron alloy powder particles were increased with the increase in the amount of Cr in the iron alloy powder, whereby the mixed powder was difficult to be densified in the sintering. In sample No. 08 in which the amount of Cr in the iron alloy powder exceeded 50 mass %, the compressibility of the mixed powder was degraded, and the mixed powder could not be compacted, whereby the sample could not be formed.

Since Cr is a carbide-generating element, in accordance with the increase in the amount of Cr, the amount of C solid solved in the matrix of the sintered alloy is decreased, whereas the amount of metallic carbides precipitated is increased, whereby the metallic carbides grow. Therefore, the area ratio of the carbides was increased. In this case, in each of the samples Nos. 01 and 02, the amount of Cr in the iron alloy powder was less than 35 mass %, whereby the area ratio of the carbides was less than 30%.

The corrosion depth was decreased with the increase in the amount of Cr (samples Nos. 01 to 06). This is because the concentration of Cr in the matrix was increased, and the area ratio of the carbides was also increased, due to the increase in the concentration of Cr. In each of the samples Nos. 01 and 02 in which the amount of Cr in the iron alloy powder was less than 35 mass %, the corrosion depth was more than 15 μm. On the other hand, in sample No. 07, the corrosion depth was increased. This is because the sintering did not sufficiently advance due to the increase in the amount of Cr, and a ratio of pores was increased, whereby corrosion resistance was decreased.

The wear amount was slightly decreased with the increase in the amount of Cr. This is because the wear resistance was improved due to the increase in the area ratio of the carbides, but the effect of Cr on the wear amount was not great.

Accordingly, the amount of Cr in the iron alloy powder should be 35 to 50 mass %.

Effects of Mo

The effects of the amount of Mo on the sintered alloy can be investigated from the results of the sintered alloy samples Nos. 05 and 09 to 15 in Table 1.

The sintered compact density ratio did not greatly vary regardless of the amount of Mo. On the other hand, the area ratio of the carbides was increased with the increase in the amount of Mo. This is because Mo is a carbide-generating element as in the case of Cr, and therefore, in accordance with the increase in the amount of Mo, the amount of C solid solved in the matrix of the sintered alloy was decreased, whereas the amount of metallic carbides precipitated was increased, whereby the metallic carbides grew. In this case, in each of the samples Nos. 09 to 11, the amount of Mo in the iron alloy powder was less than 3.0 mass %, whereby the area ratio of the carbides was less than 30%. On the other hand, in sample No. 15, the amount of Mo in the iron alloy powder exceeded 10.3 mass %, whereby the area ratio of the carbides exceeded 70%.

The corrosion depth was decreased with the increase in the amount of Mo (samples Nos. 05 and 09 to 15). This is because the concentration of Cr in the matrix was increased, and the area ratio of the carbides was also increased, due to the increase in the concentration of Mo. In this case, in each of the samples Nos. 09 to 11 in which the amount of Mo in the iron alloy powder was less than 3.0 mass %, the corrosion depth exceeded 15 μm. On the other hand, in samples Nos. 14 and 15, the corrosion depth did not vary. In view of this, even when the area ratio of the carbides exceeds 70%, the corrosion resistance is not further improved.

The wear amount was slightly decreased with the increase in the amount of Mo. This is because the wear resistance was improved due to the increase in the area ratio of the carbides. However, as in the case of Cr, the effect of Mo for improving the wear amount is not great.

Accordingly, the amount of Mo in the iron alloy powder must be not less than 3.0 mass %, and the area ratio of the carbides must not be less than 30%. In addition, considering that the area ratio of the carbides was 70% when the amount of Mo was 10.3 mass % in the iron alloy powder, the effects of Mo do not further increase even when the amount of Mo exceeds 10.3 mass % in the iron alloy powder.

Effects of P

The effects of the amount of P on the sintered alloy can be investigated from the results of the sintered alloy samples Nos. 05 and 16 to 21 in Table 1.

In sample No. 16 including P at less than 0.3 mass % in the overall composition, the liquid phase of the eutectic component of iron-phosphorous-carbon was not sufficiently generated in the sintering, whereby densification was not increased by the sintering, and the sintered compact density ratio was less than 90% and was low. In contrast, in sample No. 17 including P at 0.3 mass % in the overall composition, the liquid phase of the eutectic component of iron-phosphorous-carbon was sufficiently generated in the sintering, whereby densification was advanced by the sintering, and the sintered compact density ratio was 90%. The sintered compact density ratio was increased with the increase in the amount of P until the amount of P was increased to 0.8 mass % in the overall composition (samples Nos. 18 and 05). Then, when the amount of P exceeded 0.8 mass % in the overall composition, the areas where the iron-phosphorous alloy powder particles existed but flowed out, remained as pores, whereby the sintered compact density ratio was decreased with the increase in the amount of P. Moreover, when the amount of P exceeded 1.8 mass % in the overall composition (sample No. 21), the sintered compact density ratio was greatly decreased to less than 90%.

The area ratio of the carbides did not greatly vary regardless of the amount of P.

The corrosion depth relates to the sintered compact density ratio, and corrosion easily progresses in a sintered compact having a low density ratio, whereas corrosion is difficult to progress in a sintered compact having a high density ratio. Therefore, in sample No. 16 including P at less than 0.3 mass % in the overall composition, the corrosion depth exceeded 15 μm and was large, whereas in sample No. 17 including P at 0.3 mass % in the overall composition, the corrosion depth was decreased to 10 μm. The corrosion depth was further decreased, and the corrosion resistance was improved, in accordance with the increase in the amount of P, until the amount of P was increased to 0.8 mass % in the overall composition (samples Nos. 18 and 05). However, when the amount of P exceeded 0.8 mass % in the overall composition, the areas where the iron-phosphorous alloy powder particles existed but flowed out, remained as pores, whereby the corrosion depth was increased. Moreover, when the amount of P exceeded 1.8 mass % in the overall composition (sample No. 21), the corrosion depth was greatly increased to more than 15 μm.

As in the case of the corrosion depth, the wear amount relates to the sintered compact density ratio, and wear is easily advanced in a sintered compact having a low density ratio, whereas wear is difficult to progress in a sintered compact having a high density ratio. Therefore, the tendency of the wear amount was similar to those of the sintered compact density ratio and the corrosion depth. The wear amount was the smallest when the amount of P was around 0.8 mass % in the overall composition. In this case, when the amount of P was in the range of 0.3 to 1.8 mass % in the overall composition, the wear amount was not more than 15 μm, and the wear resistance was superior.

Accordingly, in order to obtain a sintered alloy having a sintered compact density ratio of not less than 90%, thereby having superior corrosion resistance and wear resistance, the amount of P must be 0.3 to 1.8 mass % in the overall composition.

Effects of C

The effects of the amount of C on the sintered alloy can be investigated from the results of the sintered alloy samples Nos. 05 and 22 to 28 in Table 1.

In sample No. 22 including C at less than 0.7 mass % in the overall composition, since the amount of C was not sufficient, the liquid phase of the eutectic component of iron-phosphorous-carbon was not sufficiently generated in the sintering, whereby densification did not increase, and the sintered compact density ratio was less than 90% and was low. In contrast, in sample No. 23 including C at 0.7 mass % in the overall composition, since the amount of C was sufficient, the liquid phase of the eutectic component of iron-phosphorous-carbon was sufficiently generated, whereby densification was increased by the sintering, and the sintered compact density ratio was 90%. In accordance with the increase in the amount of C in the overall composition, densification was accelerated by the sintering, and the sintered compact density ratio was slightly increased. On the other hand, in sample No. 28 including C at more than 3.9 mass % in the overall composition, the amount of the carbides precipitated in the iron alloy powder was excessive, whereby the compressibility of the iron alloy powder was decreased. In addition, in this sample, the amount of the graphite powder added as one of the raw powders was greatly increased, thereby greatly decreasing the compressibility of the mixed powder. As a result, a green compact having a compact density of 5.5 $Mg/m^3$ in this sample could not be formed.

The amount of the carbides was increased with the increase in the amount of C in the overall composition, and the area ratio of the carbides was increased accordingly. In sample No. 22 including C at less than 0.7 mass % in the overall composition, since the amount of C was not sufficient, the area ratio of the carbides was less than 30%. In contrast, in sample No. 23 including C at 0.7 mass % in the overall composition, since the amount of C was sufficient, the area ratio of the carbides was 30%.

Since the amount of the carbides was increased with the increase in the amount of C in the overall composition, and the carbides covered portions called "chromium-depleted areas", in which the concentration of Cr was relatively decreased, the corrosion depth was decreased until the amount of C was increased to 2.4 mass %. However, when the amount of C was increased relative to the amount of Cr, the Cr, which was to be solid solved in the matrix of the sintered alloy for improving the corrosion resistance, was precipitated as carbides, whereby the corrosion resistance of the matrix of the sintered alloy was decreased, and the corrosion depth was increased. The corrosion depth was still not more than 15 μm, and the corrosion resistance was superior, until the amount of C was increased to 3.9 mass %.

Since the amount of the carbides was increased with the increase in the amount of C in the overall composition, the wear amount was decreased accordingly. In sample No. 22 including C at less than 0.7 mass % in the overall composition, since the amount of C was not sufficient, the area ratio of the carbides was less than 30%, as described above, whereby the wear amount was more than 15 μm.

Accordingly, a sintered alloy having superior corrosion resistance and superior wear resistance is obtained by adding C at 0.7 to 3.9 mass % in the overall composition.

The sintered alloy of the present invention is superior in heat resistance and wear resistance and also has superior corrosion resistance against salt damage that may occur in cold-weather regions. Therefore, the sintered alloy of the present invention can be utilized for turbo components of turbochargers, in particular, heat resistant bearings that must have heat resistance, corrosion resistance, and wear resistance, and the like.

What is claimed is:

1. A sintered alloy consisting of, by mass %, 32.4 to 48.4% of Cr, more than 3.0% and not more than 10.0% of Mo, 0.9 to 2.9% of Si, 0.3 to 1.8% of P, 0.7 to 3.9% of C, and the balance of Fe and inevitable impurities, having a density ratio of not less than 90%, and including carbides that are dispersed in a matrix of a metallic structure thereof, wherein the carbides are dispersed in the metallic structure, except for pores, at 35 to 70% by area ratio.

2. The sintered alloy according to claim 1, wherein the carbides are dispersed in the metallic structure, except for pores, in a condition in which the carbides are continuously connected so as to surround portions of the matrix, thereby dividing the matrix into a plurality of the portions.

3. The sintered alloy according to claim 1, wherein Mo is present in an amount of ≥4.7 mass %.

4. A production method for the sintered alloy of claim 1, the method comprising:

preparing an iron alloy powder consisting of, by mass %, 35.0 to 50.0% of Cr, 3.0 to 10.3% of Mo, 1.0 to 3.0% of Si, 0.5 to 2.5% of C, and the balance of Fe and inevitable impurities, an iron-phosphorous alloy powder including P at 10 to 30 mass %, and a graphite powder; mixing 3.0 to 6.0 mass % of the iron-phosphorous alloy powder and 0.2 to 1.5 mass % of the graphite powder with the iron alloy powder so as to obtain a mixed powder; compacting the mixed powder into a green compact; and sintering the green compact.

* * * * *